United States Patent [19]

Fraser

[11] Patent Number: 5,036,793

[45] Date of Patent: Aug. 6, 1991

[54] DOCTOR BLADE APPARATUS

[75] Inventor: Neil S. Fraser, Elderslie, Great Britain

[73] Assignee: Stottard Sekers International plc, Elderslie, Scotland

[21] Appl. No.: 409,127

[22] Filed: Sep. 19, 1989

[30] Foreign Application Priority Data

Sep. 20, 1988 [GB] United Kingdom ..... 8822049

[51] Int. Cl.[5] ..... B05C 11/04

[52] U.S. Cl. ..... 118/126; 15/256.5; 118/413; 118/428

[58] Field of Search ..... 118/121, 122, 126, 253, 118/413, 427, 428, 407; 156/72; 162/281; 15/256.5

[56] References Cited

U.S. PATENT DOCUMENTS

| | | | |
|---|---|---|---|
| Re. 30,789 | 11/1981 | Pilgrim et al. | 118/413 |
| 1,484,705 | 2/1924 | Frothingham et al. | 118/413 |
| 2,860,597 | 11/1958 | Works et al. | 118/413 |
| 3,465,716 | 9/1969 | Barnes | 118/428 |
| 4,520,049 | 5/1985 | Nakanishi | 118/413 |
| 4,644,900 | 2/1987 | Poterala | 118/413 |

*Primary Examiner*—Michael Wityshyn

*Attorney, Agent, or Firm*—Ratner & Prestia

[57] ABSTRACT

A doctor blade and baseplate are adjustable to define a desired gap therebetween. The doctor blade is fixed in position, gap adjustment being effected by movement of the baseplate. Initial setting-up and levelling are effected by turnbuckles moving a supporting bar. The base plate is slidable vertically on the supporting bar via a pin-and-slot connection. Fine gap adjustment during operation is by screw jacks connected between the supporting bar and the baseplate and operated by a common driveshaft.

6 Claims, 2 Drawing Sheets

15
16
14
18
A
10
20
34
24
30
26
22
28
12

DOCTOR BLADE APPARATUS

This invention relates to apparatus using a doctor blade to achieve even spreading of a liquid or viscous substance on a backing member.

The invention will be described herein with specific reference to the manufacture of carpet, but may equally be used in other applications.

It is known to manufacture carpet by implanting tufts in an adhesive composition spread on a backing material. See for example British Patent No. 1,121,036 (and U.S. Pat. No. 3,691,069), the disclosure of which is incorporated herein by reference. This requires the adhesive to be applied to a moving web of backing material in such a way as to form a uniform layer, which is normally done by means of a doctor blade. To accommodate variations, in the thickness of the backing material and in the desired adhesive layer, the doctor blade is mounted for adjustment towards and away from a structural element over which the backing material passes.

It is desirable for the carpet to be produced in considerable width, and this typically requires a doctor blade about 18 feet in length, which is normally built up from a number of machined sections secured to a supporting beam. In order to maintain the edge of the blade accurately level across this width, it is necessary to make the supporting beam relatively massive, and this in turn requires considerable strength in the adjusting mechanism.

An object of the present invention is to provide an improved doctor blade apparatus with a simplified adjustment means.

Accordingly, the invention provides a doctor blade apparatus including means for moving a web of material along a substantially horizontal path, a base member positioned below said path and spanning across it, a doctor blade assembly positioned above said path and cooperating with the base member to define a gap of selected height, and means for adjusting said gap; and in which the doctor blade assembly is fixed, and said gap adjusting means comprises actuator means for moving the base member towards and away from the doctor blade assembly.

Preferably, the actuator means comprises a plurality of jacks spaced along the base member.

The jacks are preferably operable simultaneously, and may suitably comprise worm drive jacks connected to a common worm drive shaft.

An embodiment of the invention will now be described, by way of example only, with reference to the drawings, in which.

Figure 1:
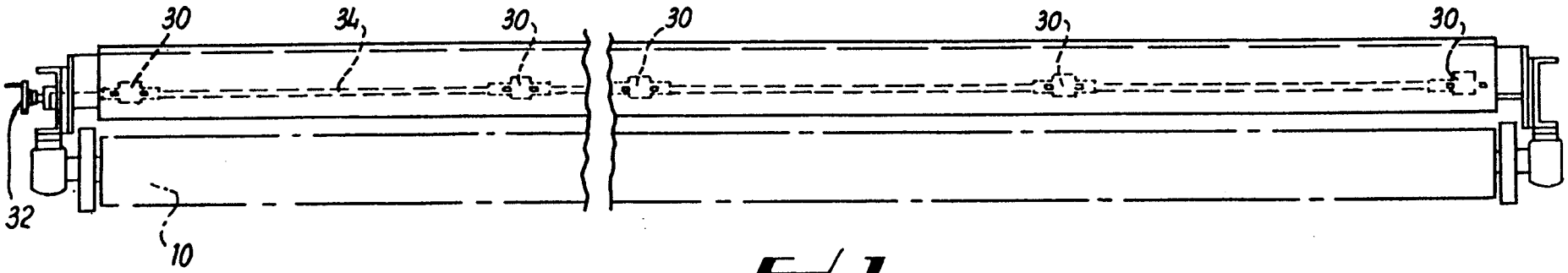
FIG. 1 is a plan view of a doctor blade apparatus forming one embodiment of the invention.
Figure 2:
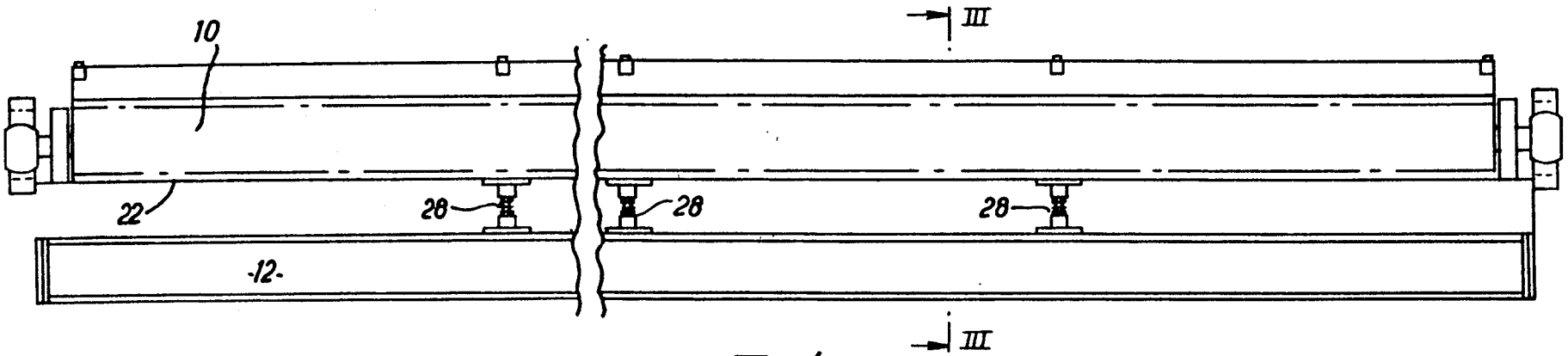
FIG. 2 is an end view of the apparatus of FIG. 1.
Figure 3:
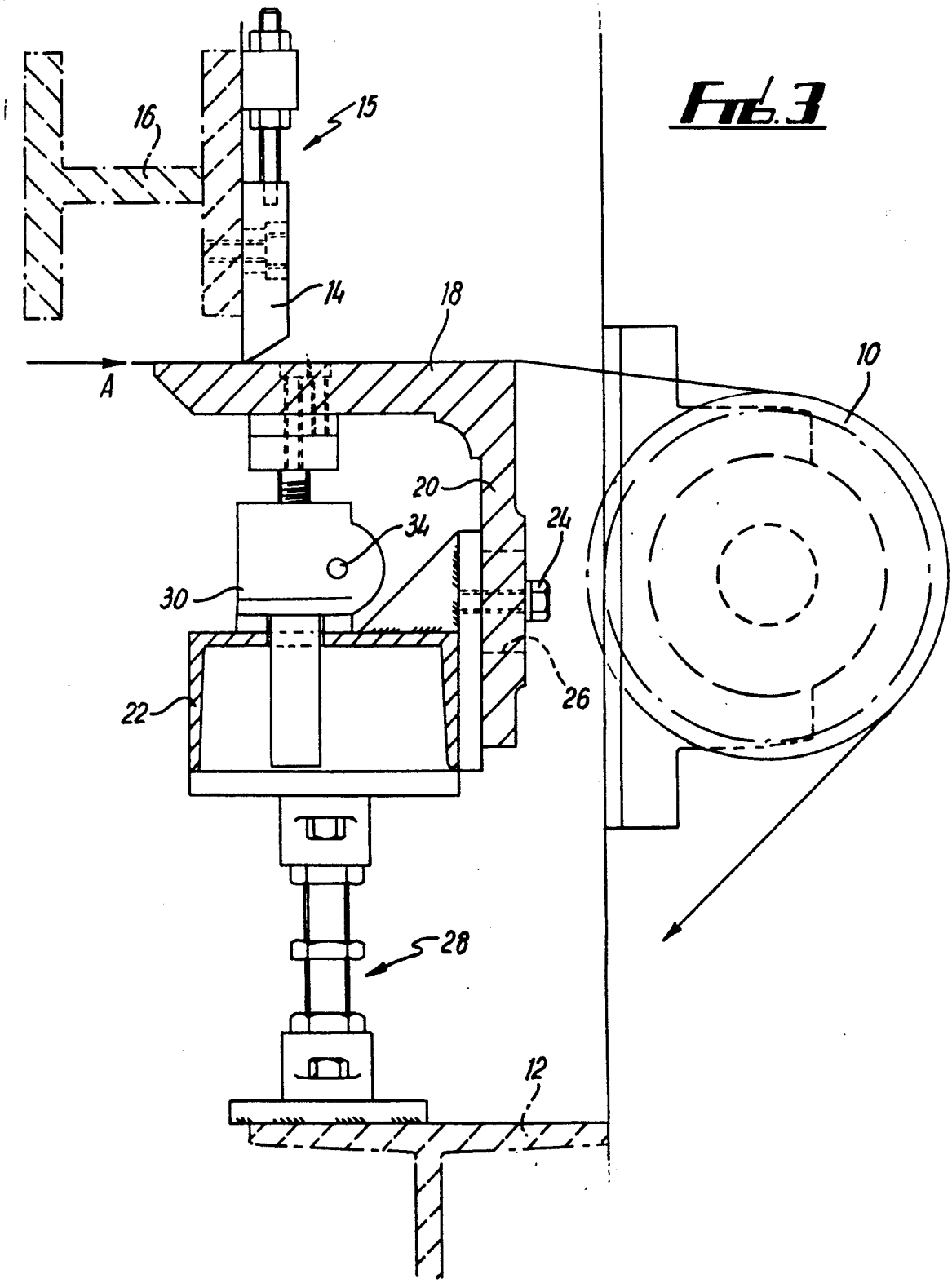
FIG. 3 is a cross-sectional side view, to an enlarged scale, taken on the line 3—3 of FIG. 2.

Referring particularly to FIG. 3, the apparatus is for use in coating a web travelling in the direction of arrow A to pass around a guide roller 10 which is fixed in relation to a machine frame indicated at 12.

A doctor assembly generally designated at 15 comprises longitudinally aligned blade members 14 secured to a beam 16 for cooperation with a base member 18 across which the web passes. In accordance with the invention, the doctor blade assembly 15 is fixed in relation to the machine frame 12, while the base member 18 is vertically adjustable to set the gap between it and the blade members 14.

To this end, the base member 18 has a vertical leg 20 mounted on a supporting bar 22 for limited vertical sliding movement by bolts 24 passing through slots 26. The supporting bar 22 is mounted on the machine frame 12, by means of a plurality of turnbuckle assemblies 28, which are provided for intial setting up and levelling of the base member 18. In use, operational adjustment of the base member 18 for varying the gap between it and the blade members 14 is effected by means of worm drive screw jacks 30 interposed between the supporting bar 22 and the base member 18. The screw jacks are actuated simultaneously by an operating handle 32 via a common worm drive shaft 34.

The screw jacks 30 may suitably be "Jacktuators" by Duff Norton, anti-backlash type, 500 kg, type no. TE 4625.

Means (not shown) may be provided for measuring the gap between the doctor blade members 14 and the base member 18, for example in the form of a micrometer or dial gauge at one end of the apparatus.

The invention thus makes it possible to provide a doctor blade apparatus with a controllable gap having a wide span, with a significant reduction in structural weight and simplification of adjustment.

I claim:

1. A doctor blade apparatus including means for moving a web of material along a substantially horizontal path, a base member positioned below said path and spanning across it, a doctor blade assembly positioned above said path and co-operating with the base member to define a gap of selected height, and means for adjusting said gap; and in which the doctor blade assembly is fixed, said base member is formed by one limb of an L-shaped member, the other limb of which is slidably connected by a pin-and-slot arrangement to a support beam, and said gap-adjusting means comprises actuator means extendible between said support beam and said base member for moving said base member toward and away from said doctor blade assembly.

2. Apparatus according to claim 1, in which the actuator means comprises a plurality of jacks spaced along the base member.

3. Apparatus according to claim 2, in which the jacks are operable simultaneously.

4. Apparatus according to claim 3, in which the jacks are worm drive jacks driven by a common drive shaft.

5. Apparatus according to claim 1, in which said support beam is mounted on a machine frame via support means which are adjustable for setting up a desired position of the support beam and levelling the support beam relative to the machine frame.

6. Apparatus according to claim 5, in which said adjustable support means comprises turnbuckles.

* * * * *

UNITED STATES PATENT AND TRADEMARK OFFICE

CERTIFICATE OF CORRECTION

PATENT NO. : 5,036,793

DATED : August 6, 1991

INVENTOR(S) : Neil S. Fraser

It is certified that error appears in the above-identified patent and that said Letters Patent is hereby corrected as shown below:

On the title page, item [73]: should be corrected to read as follows:

--[73] Assignee: Stoddard Sekers International plc, Elderslie, Scotland--.

Signed and Sealed this

Second Day of March, 1993

*Attest:*

STEPHEN G. KUNIN

*Attesting Officer*

*Acting Commissioner of Patents and Trademarks*